US007178272B2

(12) United States Patent
Xie

(10) Patent No.: US 7,178,272 B2
(45) Date of Patent: Feb. 20, 2007

(54) SNAP BLOCK STRUCTURE FOR BICYCLE-USE SHOES

(76) Inventor: Jin-Long Xie, 58, Ma Yuan West St., Taichung (TW)

( * ) Notice: Subject to any disclaimer, the term of this patent is extended or adjusted under 35 U.S.C. 154(b) by 276 days.

(21) Appl. No.: 10/895,679

(22) Filed: Jul. 22, 2004

(65) Prior Publication Data

US 2006/0016102 A1 Jan. 26, 2006

(51) Int. Cl.
*A43B 5/00* (2006.01)

(52) U.S. Cl. ..... 36/131; 74/594.6

(58) Field of Classification Search ..... 36/131, 36/132; 74/594.6, 594.4
See application file for complete search history.

(56) References Cited

U.S. PATENT DOCUMENTS 4,893,420 A * 1/1990 Bezin et al. ..... 36/131
5,079,968 A * 1/1992 Starner ..... 74/594.6
5,125,173 A * 6/1992 Nagano et al. ..... 36/131
5,205,056 A * 4/1993 Okajima et al. ..... 36/131
5,685,093 A * 11/1997 Lin ..... 36/131
5,724,752 A * 3/1998 Lin ..... 36/131
5,836,094 A * 11/1998 Figel ..... 36/131
6,189,242 B1 * 2/2001 Lin ..... 36/131
6,260,291 B1 * 7/2001 Farys ..... 36/131
6,536,304 B2 * 3/2003 Peyre ..... 74/594.6
6,990,752 B2 * 1/2006 Garneau ..... 36/3 R
2001/0022041 A1 * 9/2001 Gebhard ..... 36/131
2002/0007696 A1 * 1/2002 Peyre ..... 74/594.6

* cited by examiner

*Primary Examiner*—Marie Patterson
(74) *Attorney, Agent, or Firm*—Alan D. Kamrath; Nikolai & Mersereau, P.A.

(57) ABSTRACT

A snap block structure for a pair of mountaineering bicycle shoes each having a bottom formed with two protruding spiked blocks and two threaded locking holes located between the two spiked blocks. The snap block structure includes a snapping member mounted on the bottom of each of the mountaineering bicycle shoes and having a top face integrally formed with a protruding block mounted between the two spiked blocks of each of the mountaineering bicycle shoes. Thus, the mountaineering bicycle shoes are available for a mountaineering bicycle pedal and also available for the road-use bicycle pedal by provision of the snap block structure, thereby enhancing the versatility of the mountaineering bicycle shoes.

5 Claims, 4 Drawing Sheets

SNAP BLOCK STRUCTURE FOR BICYCLE-USE SHOES

BACKGROUND OF THE INVENTION

1. Field of the Invention

The present invention relates to a snap block structure, and more particularly to a snap block structure for bicycle-use shoes.

2. Description of the Related Art

In general, the type of a bicycle includes a road-use bicycle and a mountaineering bicycle, so that the two different types of bicycles need to mate with two different types of shoes, snap blocks and bicycle pedals. In practice, the snap block is mounted on the bottom of the bicycle shoe and snapped onto the bicycle pedal to secure the bicycle shoe on the bicycle pedal. Thus, two different types of snap blocks, including a mountaineering snap block and a road-use snap block, are provided so as to mate with bicycle shoes and bicycle pedals of different types.

A conventional mountaineering snap block 51 in accordance with the prior art shown in FIG. 5 is mounted on the bottom of one of a pair of mountaineering bicycle shoes 50 and snapped onto a mountaineering bicycle pedal 60 so as to secure each of the mountaineering bicycle shoes 50 on the mountaineering bicycle pedal 60. The bottom of each of the mountaineering bicycle shoes 50 is formed with two protruding spiked blocks 52, and the conventional snap block 51 is mounted between and hidden in the two spiked blocks 52.

However, the conventional mountaineering snap block 51 is only available for a mountaineering bicycle and cannot be used in a road-use bicycle, thereby decreasing the versatility of the conventional mountaineering snap block 51 and the mountaineering bicycle shoes 50.

SUMMARY OF THE INVENTION

The primary objective of the present invention is to provide a snap block structure, wherein the mountaineering bicycle shoes are available for a mountaineering bicycle pedal and also available for the road-use bicycle pedal by provision of the snap block structure, thereby enhancing the versatility of the mountaineering bicycle shoes.

In accordance with one embodiment of the present invention, there is provided a snap block structure in combination with one of a pair of mountaineering bicycle shoes, each of the mountaineering bicycle shoes having a bottom formed with two protruding spiked blocks and two threaded locking holes located between the two spiked blocks, the snap block structure comprising:

a snapping member mounted on the bottom of each of the mountaineering bicycle shoes and having a top face integrally formed with a protruding block mounted between the two spiked blocks of each of the mountaineering bicycle shoes.

In accordance with another embodiment of the present invention, there is provided a snap block structure in combination with one of a pair of mountaineering bicycle shoes, each of the mountaineering bicycle shoes having a bottom formed with two protruding spiked blocks and two threaded locking holes located between the two spiked blocks, the snap block structure comprising:

a snapping member mounted on the bottom of each of the mountaineering bicycle shoes and including:

a snapping plate rested on the bottom of each of the mountaineering bicycle shoes; and an insertion plate mounted on the snapping plate and located between the two spiked blocks of each of the mountaineering bicycle shoes.

Further benefits and advantages of the present invention will become apparent after a careful reading of the detailed description with appropriate reference to the accompanying drawings.

DETAILED DESCRIPTION OF THE INVENTION

Figure 1:
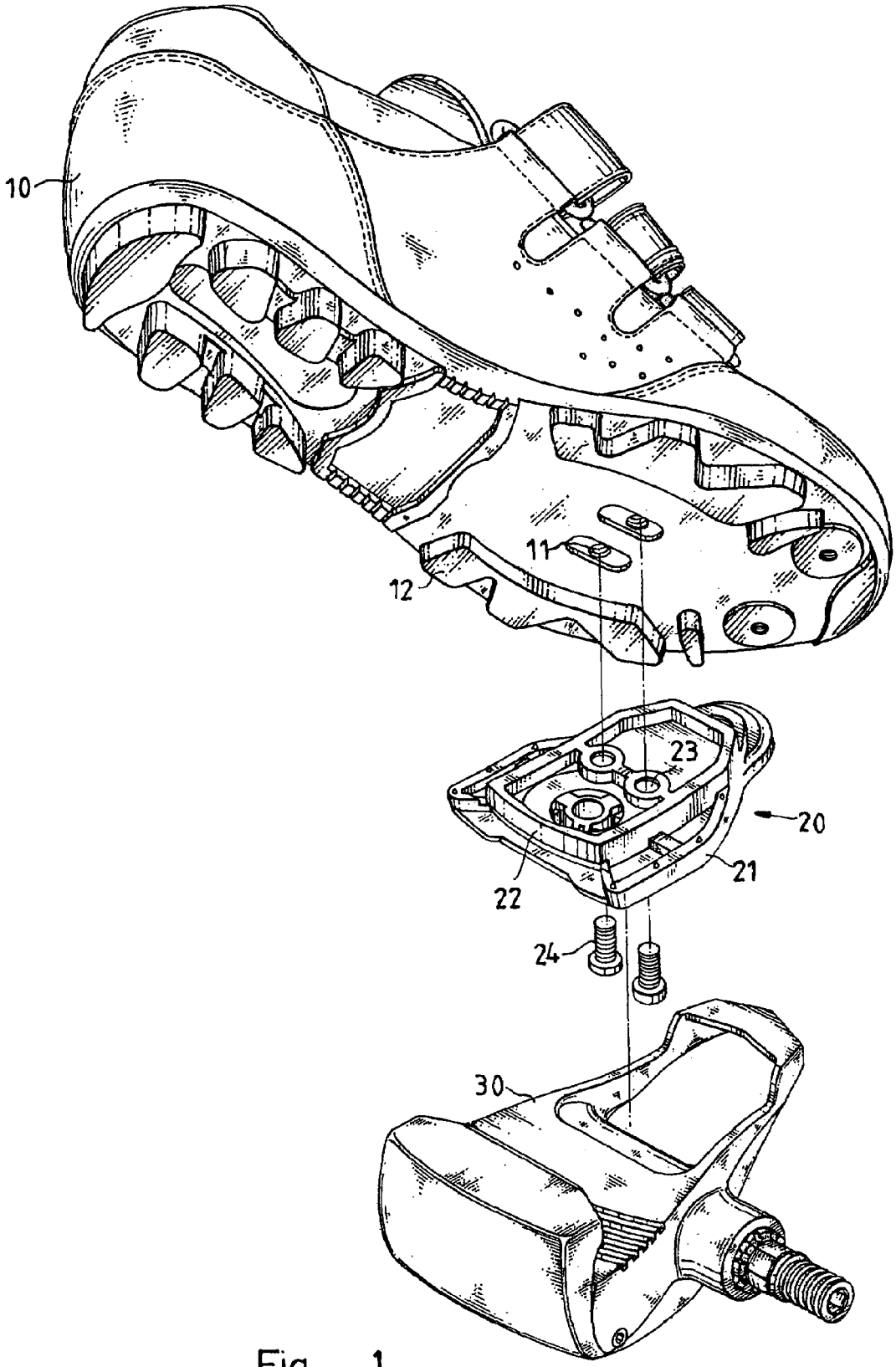
FIG. 1 is an exploded perspective view of a snap block structure in accordance with the preferred embodiment of the present invention.

Referring to the drawings and initially to FIG. 1, a snap block structure 20 in accordance with the preferred embodiment of the present invention is mounted on each of a pair of mountaineering bicycle shoes 10, so that each of the mountaineering bicycle shoes 10 is mounted on a road-use bicycle pedal 30 by the snap block structure 20.

Each of the mountaineering bicycle shoes 10 has a bottom formed with two protruding spiked blocks 12 and two threaded locking holes 11 located between the two spiked blocks 12.

The snap block structure 20 comprises a snapping member 21, and two locking bolts 24.

The snapping member 21 of the snap block structure 20 is mounted on the bottom of each of the mountaineering bicycle shoes 10 and has a top face integrally formed with a substantially loop-shaped protruding block 22 mounted between the two spiked blocks 12 of each of the mountaineering bicycle shoes 10. The protruding block 22 of the snapping member 21 has a mediate portion formed with two through holes 23 aligning with the two locking holes 11 of each of the mountaineering bicycle shoes 10.

Each of the two locking bolts 24 of the snap block structure 20 is extended through a respective one of the two through holes 23 of the protruding block 22 of the snapping member 21 and screwed into a respective one of the two locking holes 11 of each of the mountaineering bicycle shoes 10 to fix the snapping member 21 on each of the mountaineering bicycle shoes 10.

When in use, the snapping member 21 is directly secured on each of the mountaineering bicycle shoes 10 by the two locking bolts 24, so that the snap block structure 20 is mounted on each of the mountaineering bicycle shoes 10 by the two locking bolts 24. In such a manner, the protruding block 22 of the snapping member 21 is mounted between the two spiked blocks 12 of each of the mountaineering bicycle shoes 10, and the snapping member 21 of the snap block structure 20 is snapped on the road-use bicycle pedal 30, so that each of the mountaineering bicycle shoes 10 is available for the road-use bicycle pedal 30 by the snap block structure 20.

Accordingly, the mountaineering bicycle shoes 10 are available for a mountaineering bicycle pedal (not shown) and also available for the road-use bicycle pedal 30 by the snap block structure 20, thereby greatly enhancing the versatility of the mountaineering bicycle shoes 10.

Figure 2:
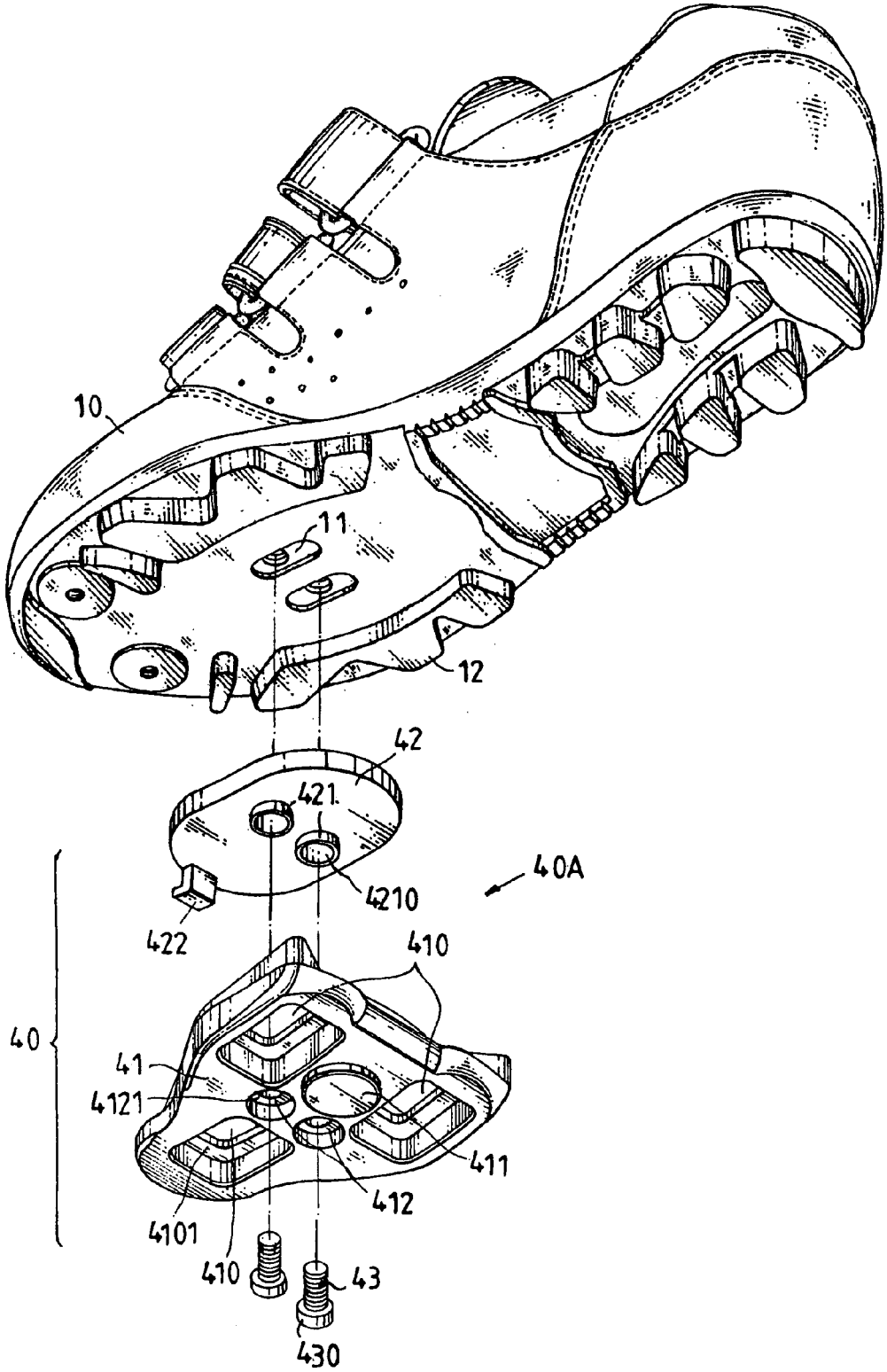
FIG. 2 is an exploded perspective view of a snap block structure in accordance with another embodiment of the present invention.
Figure 3:
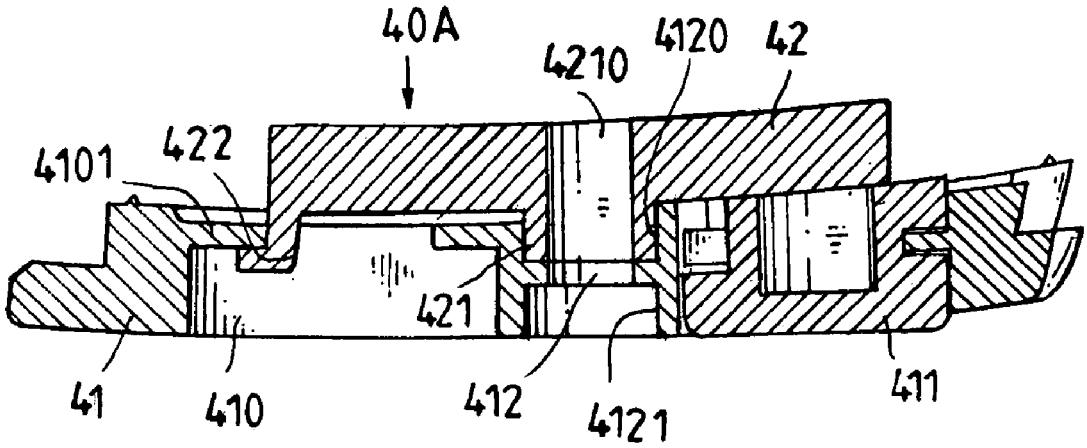
FIG. 3 is a plan cross-sectional assembly view of the snap block structure as shown in FIG. 2.

Referring to FIGS. 2 and 3, a snap block structure 40 in accordance with another embodiment of the present invention comprises a snapping member 40A, and two locking bolts 43.

The snapping member 40A is mounted on the bottom of each of the mountaineering bicycle shoes 10 and includes a snapping plate 41, and an insertion plate 42.

The snapping plate 41 of the snapping member 40A is rested on the bottom of each of the mountaineering bicycle shoes 10 and has a mediate portion formed with two mounting holes 412 each having a first side formed with a stepped insertion recess 4120 (see FIG. 3) and a second side formed with a stepped receiving recess 4121. The snapping plate 41 of the snapping member 40A is available for road-use bicycle shoes (not shown) and has a periphery formed with a plurality of mounting bores 410 for mounting washers and bolts so as to lock the snapping plate 41 on each of the road-use bicycle shoes. Each of the mounting bores 410 of the snapping plate 41 has an inside formed with a catch edge 4101. The snapping plate 41 of the snapping member 40A is formed with an anti-skid pad 411 located between the mounting bores 410.

The insertion plate 42 of the snapping member 40A is mounted on the snapping plate 41 and located between the two spiked blocks 12 of each of the mountaineering bicycle shoes 10. The insertion plate 42 of the snapping member 40A is slightly smaller than the snapping plate 41 and has a mediate portion formed with two protruding stubs 421 each inserted into the insertion recess 4120 of a respective one of the two mounting holes 412 of the snapping plate 41 and each formed with a through hole 4210 aligning with a respective one of the two mounting holes 412 of the snapping plate 41 and a respective one of the two locking holes 11 of each of the mountaineering bicycle shoes 10. The insertion plate 42 of the snapping member 40A has a side formed with a hook-shaped elastic locking leg 422 inserted into one of the mounting bores 410 of the snapping plate 41 and locked on the catch edge 4101 of the respective mounting bore 410, so that the insertion plate 42 is secured on the snapping plate 41.

Each of the two locking bolts 43 is extended through a respective one of the two mounting holes 412 of the snapping plate 41 and the through hole 4210 of a respective one of the two protruding stubs 421 of the insertion plate 42, and screwed into a respective one of the two locking holes 11 of each of the mountaineering bicycle shoes 10 to fix the snapping member 40A on each of the mountaineering bicycle shoes 10. Each of the two locking bolts 43 has a bolt head 430 received in the receiving recess 4121 of a respective one of the two mounting holes 412 of the snapping plate 41.

When in use, the snapping member 40A is directly secured on each of the mountaineering bicycle shoes 10 by the two locking bolts 43, so that the snap block structure 40 is mounted on each of the mountaineering bicycle shoes 10 by the two locking bolts 43. In such a manner, the insertion plate 42 of the snapping member 40A is mounted between the two spiked blocks 12 of each of the mountaineering bicycle shoes 10, and the snapping plate 41 of the snapping member 40A is snapped on the road-use bicycle pedal 30 (see FIG. 1), so that each of the mountaineering bicycle shoes 10 is available for the road-use bicycle pedal 30 by the snap block structure 40.

Accordingly, the mountaineering bicycle shoes 10 are available for a mountaineering bicycle pedal (not shown) and also available for the road-use bicycle pedal 30 by the snap block structure 40, thereby greatly enhancing the versatility of the mountaineering bicycle shoes 10.

Figure 4:
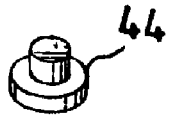
FIG. 4 is a perspective view of a plug of the snap block structure as shown in FIG. 2.
Figure 5:
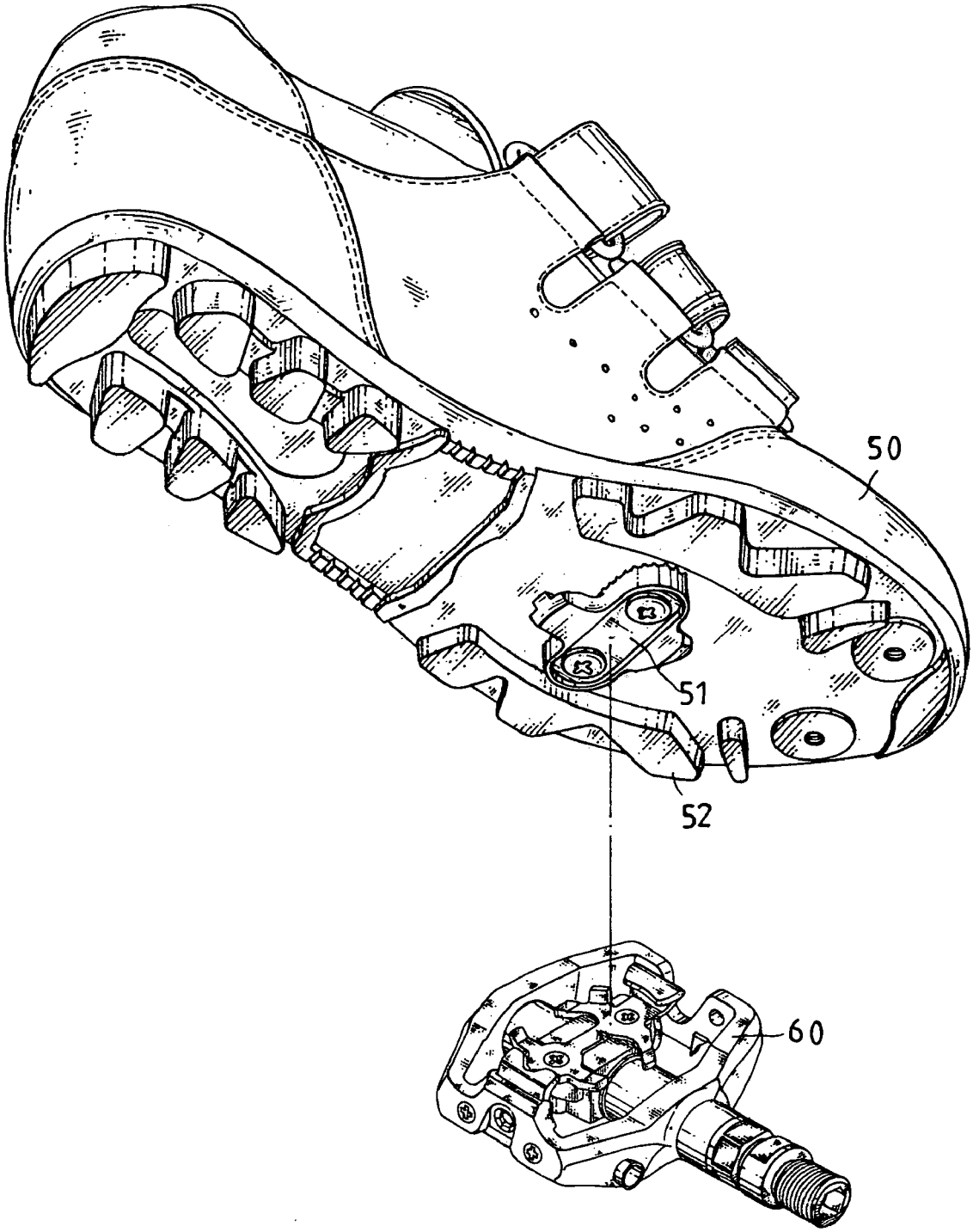
Fig. 5 PRIOR ART
FIG. 5 is an exploded perspective view of a conventional snap block or one of a pair of mountaineering bicycle shoes in accordance with the prior art.

Referring to FIGS. 2 and 4, the snapping member 40A further includes two plugs 44 each detachably inserted into a respective one of the two mounting holes 412 of the snapping plate 41, so that the snapping plate 41 is used individually.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A snap block structure in combination with one of a pair of mountaineering bicycle shoes, each of the mountaineering bicycle shoes having a bottom formed with two protruding spiked blocks and two threaded locking holes located between the two spiked blocks, the snap block structure comprising:

a snapping member mounted on the bottom of each of the mountaineering bicycle shoes and including:

a snapping plate rested on the bottom of each of the mountaineering bicycle shoes; and an insertion plate mounted on the snapping plate and located between the two spiked blocks of each of the mountaineering bicycle shoes;

wherein the snapping plate of the snapping member has a mediate portion formed with two mounting holes each having a first side formed with a stepped insertion recess and a second side formed with a stepped receiving recess, the insertion plate of the snapping member has a mediate portion formed with two protruding stubs each inserted into the insertion recess of a respective one of the two mounting holes of the snapping plate and each formed with a through hole aligning with a respective one of the two mounting holes of the snapping plate and a respective one of the two locking holes of each of the mountaineering bicycle shoes, and the snap block structure further comprises two locking bolts each extended through a respective one of the two mounting holes of the snapping plate and the through hole of a respective one of the two protruding stubs of the insertion plate, and screwed into a respective one of the two locking holes of each of the mountaineering bicycle shoes to fix the snapping member on each of the mountaineering bicycle shoes.

2. The snap block structure in accordance with claim 1, wherein the each of the two locking bolts has a bolt head received in the receiving recess of a respective one of the two mounting holes of the snapping plate.

3. A snap block structure in combination with one of a pair of mountaineering bicycle shoes, each of the mountaineering bicycle shoes having a bottom formed with two protruding spiked blocks and two threaded locking holes located between the two spiked blocks, the snap block structure comprising:

a snapping member mounted on the bottom of each of the mountaineering bicycle shoes and including:

a snapping plate rested on the bottom of each of the mountaineering bicycle shoes;

an insertion plate mounted on the snapping plate and located between the two spiked blocks of each of the mountaineering bicycle shoes;

wherein the snapping plate of the snapping member has a periphery formed with a plurality of mounting bores each having an inside formed with a catch edge, and the insertion plate of the snapping member has a side formed with a hook-shaped elastic locking leg inserted into one of the mounting bores of the snapping plate and locked on the catch edge of the respective mounting bore, so that the insertion plate is secured on the snapping plate.

4. The snap block structure in accordance with claim 1, wherein the insertion plate of the snapping member is smaller than the snapping plate.

5. The snap block structure in accordance with claim 1, wherein the snapping member further includes two plugs each detachably inserted into a respective one of the two mounting holes of the snapping plate, so that the snapping plate is used individually.

* * * * *